United States Patent [19]

De Smet

[11] Patent Number: 4,770,015

[45] Date of Patent: Sep. 13, 1988

[54] PROCESS AND DEVICE FOR PRESS-FORMING SHEET MATERIAL HAVING A SMALL ELONGATION

[75] Inventor: Gabriel De Smet, Courbevoie, France

[73] Assignee: Usinor Aciers, Puteaux, France

[21] Appl. No.: 937,337

[22] Filed: Dec. 3, 1986

[30] Foreign Application Priority Data

Dec. 4, 1985 [FR] France ..... 85 17957

[51] Int. Cl.[4] ..... B21D 39/08

[52] U.S. Cl. ..... 72/57; 29/421.1; 72/63

[58] Field of Search ..... 72/57, 63; 29/421 R, 29/421 E

[56] References Cited

U.S. PATENT DOCUMENTS

| | | | |
|---|---|---|---|
| 2,422,883 | 6/1947 | Bruderlin . | |
| 2,602,411 | 7/1952 | Schnell . | |
| 2,749,867 | 6/1956 | Engel . | |
| 3,380,272 | 4/1968 | Halter | 72/57 |
| 3,552,165 | 1/1971 | Taylor | 72/57 |
| 3,914,969 | 10/1975 | Banks | 72/63 |
| 4,145,903 | 3/1979 | Leach et al. . | |

FOREIGN PATENT DOCUMENTS

| | | | |
|---|---|---|---|
| 2131811 | 12/1972 | Fed. Rep. of Germany | 72/63 |
| 2564339 | 11/1985 | France . | |
| 863075 | 9/1981 | U.S.S.R. | 72/57 |
| 603683 | 6/1948 | United Kingdom | 72/63 |

*Primary Examiner*—W. Donald Bray

*Attorney, Agent, or Firm*—Cushman, Darby & Cushman

[57] ABSTRACT

Process for press-forming sheet materials and in particular metal sheets on a double-action press of the type comprising a cushion (5) of an elastically yieldable material, the process comprising disposing the sheet on a support, applying a first outer slide (1) on the peripheral portion of the sheet (4), then applying a second central slide (10) on a central portion of the sheet, the process further comprising disposing the peripheral portion of the sheet on a lower blank holder (3) forming a tank for the cushion (5) and having an upper surface (6) for maintaining the sheet and located at a higher level than the level of the working surface (7) of the cushion (5), applying the first outer slide, which has a body (8) having a cross-section less than the lower blank holder (3) and includes on its periphery an upper blank holder (2) cooperative with the lower blank holder (3) for gripping the sheet (4), continuing the descent of the outer slide (1) against the cushion for turning up an edge portion (20) of the sheet and causing the flow of the mass of the cushion and deform the central portion of the sheet in such manner as to impart thereto an area substantially equal to the area of the finished part to be obtained, then displacing the central slide (10) so as to shape the angular volumes and the central portion of the sheet by a final flow of the cushion. The invention also provides a press-forming device of the double-action press type. Application in the press-forming of sheets of large size and small elongation.

23 Claims, 3 Drawing Sheets

PROCESS AND DEVICE FOR PRESS-FORMING SHEET MATERIAL HAVING A SMALL ELONGATION

The present invention relates to a process and a device for press-forming sheet materials having a small elongation, and more particularly, although not exclusively, to steels having a high elastic limit termed HEL.

The press-forming of parts of large dimensions is usually carried out by drawing with mechanical or hydraulic double-action presses. These apparatus mainly comprise a fixed die and two independent slides, namely a central slide, termed a piston plunger or ram carrying a punch, and an outer slide used for holding the blank, i.e. for providing a sufficient maintenance to permit the drawing under the punch by reaction. The movements are usually the followings: (1) a rapid descent of the blank holder which maintains a constant pressure on the sheet and thus prevents it from moving; (2) a rapid descent of the punch until it comes into contact with the sheet, then (3) a slow descent of the punch during the press-forming stage, namely the drawing proper; and (4) a rapid rising of the central side which raises the blank holder therewith.

The use of this conventional technique which is based on the aptitude of extra-mild steels to elongate, however rapidly reaches its limits with HEL steels owing to their coefficient of elongation which is very severely reduced (less than about one half).

The reduction in the possible elongation renders substantially obligatory the consumption of metal coming from the peripheral zone of the sheet under the blank holder.

During the press-forming operation, this reduction in the projected area of the blank requires for the purpose of avoiding the formation of pleats, a much higher holding pressure for HEL steels than for extra-mild steels.

This high pressure promotes seizure and causes a rapid wear of the blank holder and of the die entrance radii.

The second difficulty encountered in the press-forming of HEL steels results from the folding or pleating of the sheet in the central part of the press-formed object when the punch acts on the sheet.

This pleating or corrugating tendency for a given punch shape is all the more marked as the sheet is thin and its resistance is high.

For overcoming the last-mentioned difficulty, the Applicant has proposed in its French patent No. 84 07 678 a press-forming process on an elastically yieldable cushion placed as a support in a double-action press.

According to this process, there is provided on the first outer slide at least one active part whose shape corresponds to the excess area relative to the volume to be formed, this active part acting on the peripheral portion of the sheet itself in contact by its other side with the elastically yieldable cushion.

This technique permits deep drawings with a substantially equal thickness and is in particular of use for extra-thin sheets. However, it is complicated since it requires the precise determination of the shapes corresponding to the excess area by complex mathematical methods and then the exact machining of these shapes for forming the active parts of the first outer slide.

These sophisticated methods are very awkward to carry out and are intended more particularly for extra-thin steels and particularly for deep-drawn products.

There is moreover known a press-forming technique employing a turning up which has heretofore been essentially employed for the deep drawing of steels having a large elongation.

This technique comprises deforming by successive steps the sheet blank by starting at its periphery, i.e. by forming up an edge. It allows very large deformations in that at each step the parameters of reduction of the area under the blank holder act in such manner as to maintain the thickness of the sheet substantially constant.

However, this technique would not permit the obtainment of complex shapes in the central part of the pressformed product. Indeed, it essentially concerns the obtainment of deep press-formed products of simple shape owing to the use of successive peripheral deformations achieved by the turning up of the edge portions.

An object of the present invention is to obtain press-formed parts of medium depth, but of large areas, such as automobile parts whose central portions are practically never of shapes of revolution but represent complex non-developpable shapes.

Now, these complex shapes cannot be produced in a single step by a metal punch without risk of formation of pleats and breakage of the press-formed product.

An object of the invention is to provide a process for press-forming sheet materials, in particular metal sheets, on a double-action press of the type comprising a cushion of an elastically yieldable material, comprising disposing the sheet to be formed on a support, applying a first outer slide on the peripheral portion of the sheet, then applying a second central slide on the central portion of the sheet, said method further comprising disposing the peripheral portion of the sheet to be formed on a lower blank holder forming a tank for the cushion of elastically yieldable material and having an upper face for maintaining the sheet which is located at a level higher than the level of the working surface of the elastically yieldable cushion, applying the first outer slide whose body has a cross-section less than the lower blank holder and which includes on its periphery an upper blank holder cooperative with the lower blank holder for gripping the sheet, continuing the descent of the outer slide against the elastically yieldable cushion so as to turn up an edge portion of the blank and cause the flowing of the mass of the elastically yieldable cushion so as to deform the central portion of the sheet in such manner as to impart thereto an area substantially equal to area of the finished part to be obtained, then displacing the central slide so as to shape the angular volumes and the central portion of the sheet by a final flowing of the support.

The essential feature of the invention resides in the turning up of a peripheral edge portion which has for object to reduce the volume of metal to be shrunk and consequently results in a decrease in the pressure corresponding to the punch, i.e. in the case of elastoforming on an elastically yieldable cushion according to the present invention in a decrease in the pressure prevailing in this cushion.

Indeed, in the process of the invention, the area of the central slide in contact with the sheet performs the function of a die bottom and the elastically yieldable cushion of flowable material that of the punch applying the sheet in the bottom of the die so as to form the angular volumes.

As the tensile and compression stresses are substantially equal, the risk of the appearance of pleats is substantially reduced.

For a press-formed part comprising in the central portion shapes having a sharp angle or small details, there is employed an outer slide whose working surface in contact with the sheet, forming a peripheral die, includes active parts such as described in the French patent No. 84 07 678 in combination with the edge turning up operation according to the present invention. Note that these active parts form a relief which may be convex or concave, according to the most advantageous technical arrangement for the considered part.

It will be recalled that these active parts determine in the peripheral portion of the sheet adjacent to the turned-up edge portion disposed under the outer slide, shapes which compensate in certain zones of the finished part for the excess areas of substantially unchanged thickness of the initial sheet relative to the volume to be formed.

These active parts may also be placed in the bottom of the die carried by the central slide when they correspond to zones of the finished part which are intended to be removed by a subsequent cutting operation.

According to other features of the invention:

the central slide is in a first stage brought to a position in which it limits the deformation of the central portion of the sheet under the flowing effect of the support material;

the material constituting the support is an elastomer having a low Shore hardness, for example lower than 30 Shore 00;

after the forming operation proper, the material constituting the support is decompressed;

the mass of the support material is cooled.

The invention also provides a press-forming device of the type comprising a support on which is placed the sheet to be formed, a first outer slide, a second central slide and a cushion of an elastically yieldable material, wherein the support is formed by a lower peripheral blank holder forming a tank for the elastically yieldable cushion, and having a surface for maintaining the sheet which is located at a level higher than that of the cushion, the outer slide having a body whose inside cross-section is less than that of the lower blank holder so as to enter the latter and turn up the edge portion of the sheet blank and reach the cushion and cause the flowing of the latter, the outer part of the outer slide carrying an upper peripheral blank holder cooperating with the lower blank holder so as to grip the sheet, and the central slide carrying a die bottom.

According to a modification, the outer slide has on its lower surface forming a peripheral die at least one active convex or concave portion in relief whose shape corresponds to the excess area of the sheet, for a substantially constant thickness, relative to the volume to be formed.

According to another embodiment of this modification, the central slide carries a die bottom including at least one active convex or concave portion in relief corresponding to the excess area of the sheet, for a substantially constant thickness, relative to the volume to be formed.

The material of the elastic support is preferably easily flowable, for example an elastomer having a Shore hardness 00 of less than 30.

According to other features:

means are provided which, in a first step, project into the mass of the supporting material and which, in a second step, can be retracted after the forming operation so as to cause a decompression of said material;

cooling means are provided in the mass of material constituting the support;

means are provided for removing the finished part from the support material.

The invention will be described hereinafter in more detail with reference to the accompanying drawings which represent two embodiments of the invention. In the drawings.

Figure 1:
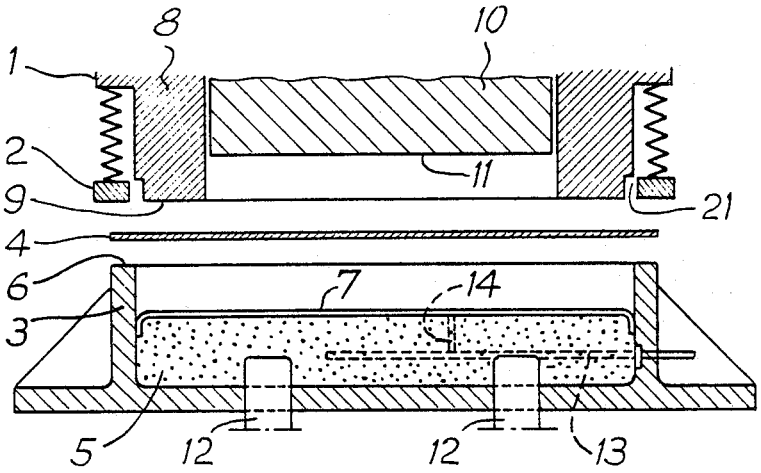
FIGS. 1 to 5 are diagrammatic sectional views of the press-forming device according to the invention in the course of the successive part-forming stages.

According to a first embodiment shown in FIGS. 1 to 5, the device of FIG. 1 comprises, in the position thereof before forming, the conventional component elements of a double-action press, and consequently only the part relating to the invention is represented.

An outer slide or ram carries in its outer part an upper peripheral blank holder 2 which cooperates with a lower peripheral blank holder 3 forming a support on which a sheet to be press-formed is disposed.

The lower peripheral blank holder 3 forms a tank in which is disposed an elastically yieldable cushion 5 which occupies the entire area of this tank. The surface 6 for maintaining the sheet is located at a level higher than the upper working surface 7 of the cushion.

The outer slide or ram 1 has a body 8 whose outside cross-section is less than the inside cross-secion of the lower blank holder 3, so that the lower surface 9 of the outer slide facing the sheet 4 can, in the absence of the latter, enter the lower blank holder 3 and reach the cushion 5 of elastically yieldable material and cause the flowing of the latter.

The central slide or ram 10 carries a die bottom 11, the peripheral portion of the die being formed by the lower surface 9 of the outer slide 1.

The outer slide 1 and the central slide 10 are actuated in synchronism as will be seen hereinafter and perform by their lower surfaces 9 and 11 the function of a die, the cushion 5 of elastically yieldable material performing, in the course of operation, the function of a punch.

The cushion 5 of elastically yieldable material is formed by an elastomer having a Shore 00 hardness lower than 30, a very important characteristic residing in the rapid return time of the material (preferably less than 1 second) for returning to its initial shape. A material based on silicon may, for example, be used.

The die bottom 11 carried by the central slide is made from a material which is easy to machine or shape, such as a plastics material, and in particular a polyurethane, polyepoxy or polyester, a concrete, a concrete to which resin is added, a composite material, these materials optionally having a filler of fibres and in particular glass, or a hard wood such as box wood.

Retractable elements 12 (pins or inflatable bags) project into the cushion 5 and their inserted volume approximately represent the increase in volume of the elastomer when it has expanded after release subsequent to the forming operation.

The cushion 5 has conduits 13 for the circulation of a cooling fluid such as compressed air. Other conduits 14, in particular when compressed air is used, may be used for removing the finished part. For the purpose of cooling the mass of the cushion 5, there may also be provided embedded metal wires or a filler of metal powder which improves the thermal conductivity.

Figure 2:
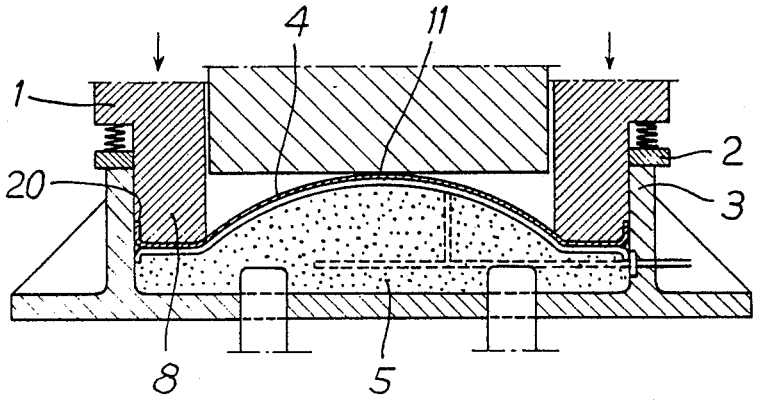

FIG. 2 shows the stage for turning up the edge portion or flange 20 of the part which is disposed in the annular recess 21 provided outside the body 8 of the outer slide 1 as shown in FIG. 1.

In the stage illustrated in FIG. 2, the outer slide 1 carrying the peripheral die 9 is lowered. This die comes into contact with the sheet blank 4 whose peripheral portion is progressively gripped between the upper blank holder 2 and lower blank holder 3 so as to prevent the formation of festoons or corrugations therein.

In the course of its descent, the peripheral die 9 forms a flange 20 on the sheet blank and at the same time compresses by reaction the elastomeric cushion 5. The latter, under the effect of this peripheral compression, acts by flowing on the central zone of the blank and causes the deformation of the latter.

The swelling of the central portion of the sheet blank is limited by the die bottom 11 fixed to the central slide 10, so as to avoid uncontrolled erratic deformations due to the anisotropy of the metal or shapes of dissymetrical parts. The descent of the outer slide 1 carrying the peripheral die 9 is limited in such manner that the deformation in the central portion of the blank produces a surface which is substantially equal to that of the finished part to be obtained.

Figure 3:
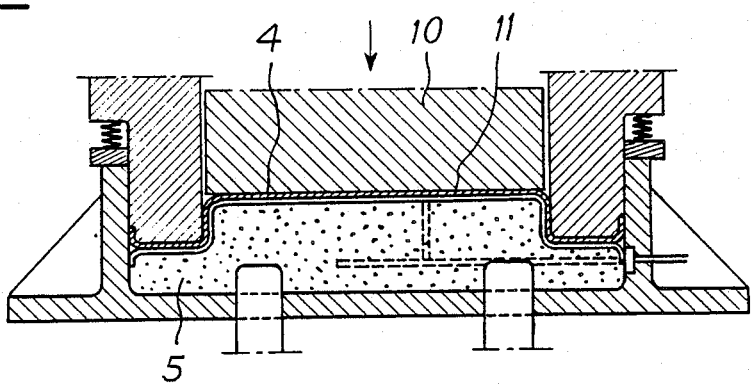

FIG. 3 represents the stage for finally shaping the part. The central slide 10 carrying the die bottom 11 descends to its lower position and causes the final forming or drawing of the central portion of the sheet 4, which was pre-formed in the course of the preceding operation.

The compressive stresses due to the bearing of the die bottom 11 on the top of the sheet is converted by the action of the elastomeric cushion 5, acting on the opposite side of the sheet, into tensile stresses exerted over the entire surface of the sheet, which are not compensated for by the presence of the die bottom 11, and cause the displacement of this sheet throughout the available volume.

These stresses (compressive, tensile) thus tend to cancel each other out (apart from the yield of the elastomer) and thus permit the final pressing of the part with a minimum of variation in thickness.

Figure 4:
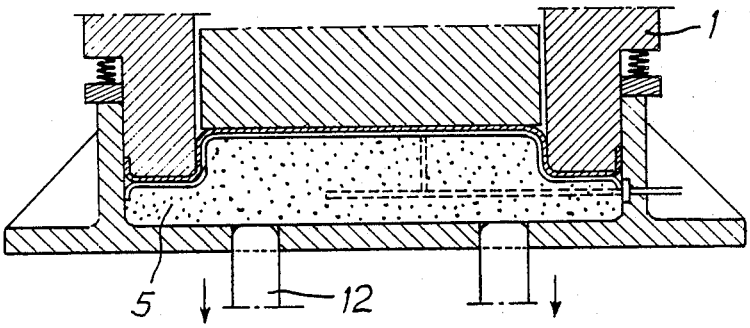

FIG. 4 shows the stage in which the elastomeric cushion 5 is decompressed by the retraction of the pins 12. This operation has for purpose to avoid the deformation of the pressed part by reaction of the release of the elastomer.

Figure 5:
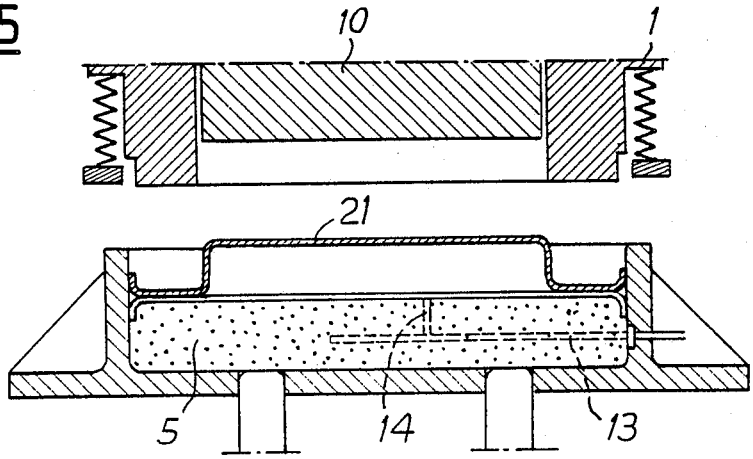

FIG. 5 represents the stage for release of the formed part 21 by a simultaneous rising of the two slides 1 and 2 carrying the die. In order to limit the heating of the elastomeric cushion 5, in particular in the course of mass-production, compressed air is circulated in the conduits 13. The cooling of the elastomer 5 may also be effected in the course of the step preceding the decompression (FIG. 4). Further, compressed air is passed through the conduits 14 so as to remove the part 21.

Figure 6:
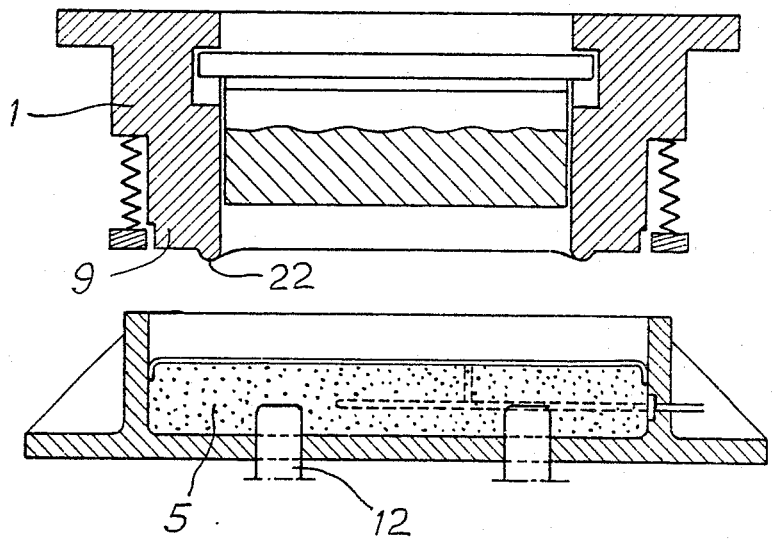
FIGS. 6 and 7 are diagrammatic sectional views of two embodiments of a modification of the press-forming device according to the invention shown solely in the preliminary stage for placing the sheet to be formed in position.

In a modification illustrated in FIG. 6, the outer slide or ram 1 carries a peripheral die 9 which has in its corners a suitable shape in convex relief, i.e. forming a projection 22 which is integral with the peripheral die 9 (this shape in relief 22 corresponds to the excess area relative to the volume to be formed of the part it is desired to produce) and its active surface is carefully polished so as to permit the displacement of the excess material during forming; this active surface may also be treated for facilitating the sliding of the sheet.

Figure 7:
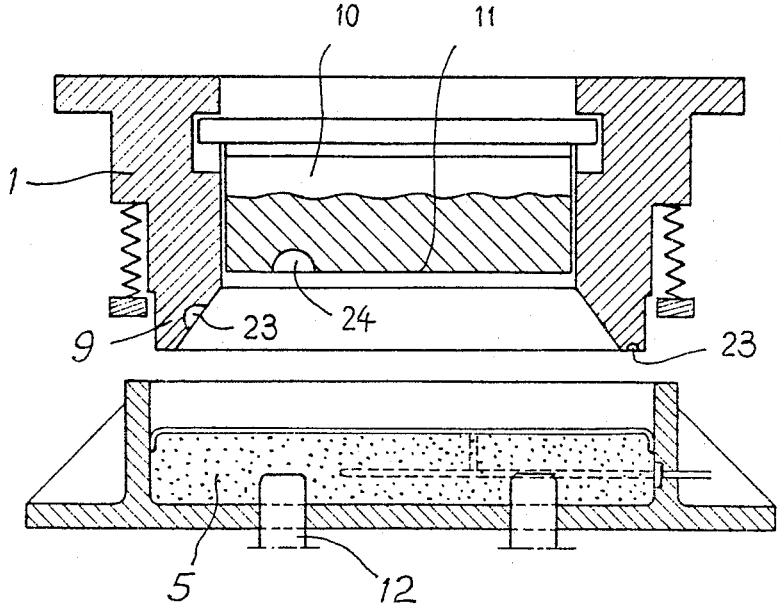

According to another embodiment of the modification of FIG. 6, illustrated in FIG. 7, the outer slide 1 carries a peripheral die 9 in which are formed concave active portions, i.e. hollow portions 23, which perform the same function as the portions 22 of FIG. 6, their arrangement being so chosen for reasons of optimization of the press-formed part. Thus, the active portions 23 could possibly be disposed in the zones of the press-formed part which will be subsequently cut away in the final part. Active portions 24 having the function defined hereinbefore may also be placed in the die bottom 11 carried by the central slide 10 when these active portions 24 are located in central zones of the pressing which will be cut away in the finished part or when the latter corresponds to the part of the sheet located essentially under the outer slide.

This embodiment is more particularly intended for forming complex shapes having sharp corners in the central portion of the pressing.

The press-forming by turning over described hereinbefore with its peripheral flange permits a reduction in the pressure required for the press-forming of the sheet by reversing the conventional cycle of the punch. The pressure which was exerted solely for the forming of the sheet on the equivalent of the die entrance radii, is applied after this inversion, on the whole of the central area of the pressing.

The pressure required for this pre-forming of the sheet is very low (value no greater than between 10 and 20 bars (1 and 2 MPa).

This low pressure process thus permits the press-forming of large areas and the creation of a new double action tool technique having an elastomeric die of a low Shore hardness which may be adapted to existing bodywork presses.

The first stage of the press-forming operation consists in the turning up of the peripheral edge portions (FIG. 2) of the blank by the outer slide 1.

The first stage at the same time produces the curved pre-formed surface which causes the expansion of the sheet and thus avoids the formation of pleats.

It is important to note that this expansion is limited in several ways:

(1) By the volume of elastomer displaced which defines the curved surface of the sheet.

(2) By the proximity of the punch which avoids the erratic deformation of the sheet and orders the predeformation.

(3) By the peripheral retention of the sheet blank which is adjusted so as to limit the bi-axial expansion of the sheet to a low value, namely 3 to 5%, this value avoiding the formation of pleats.

As the curvature of the surface of the sheet is mainly obtained by a multidirectional bending of the sheet, this permits, in the course of the forming operation of the second and last stage of the press-forming operation which will modify these bendings, a very large potentiality of re-arrangement of the shapes.

Although the description has been made with reference to the forming of sheets, i.e. thin usually metal plates, it must however be understood that the process according to the invention is in no way intended to be limited to this application, as is clearly indicated in the first two lines of the description. Thus, the process of the present invention may be used with thin plates or sheets, for example of plastics material.

Among the plastics materials which may be press-formed by the process of the present invention, there may be mentioned, by way of a non-limiting example:

a polybutene whose properties are described in the work "Matières Plastiques" in the chemical applications of Jean BOST, p. 244–245;

a polyethylene, a chlorinated polyethylene, a polypropylene, a PVC;

a chlorinated PVC, an ABS resin (acrylonitrile, butadiene, styrene), a polycarbonate, polyphenylene oxide, polysulfone, chlorotrifluoroethylene, acetate cellulose, butyrate acetate cellulose, polyacetal, phenoxy, nylon 6, nylon 66; the properties of these plastics materials are, for example, described in "Polymers Engineering and Science", March 1971, volume 11, No. 2, p. 106. Further, plastics materials must also be understood to include composite materials optionally including fillers.

Thus, in the present description, the term "sheet" must have the general meaning of a thin plate of sheet material without limiting the scope of the invention to metal products.

The process of the present invention may also be carried out for the thermoforming of sheet materials. In this case, the materials may be previously heated to a temperature which does not degrade the material constituting the elastically yieldable cushion.

What is claimed is:

1. A process for press-forming sheet materials, in particular metal sheets, on a double-action press comprising a cushion of an elastically yieldable material having a working surface, said process comprising disposing a blank of the sheet material to be formed on a support, applying a first outer slide on a peripheral portion of the sheet, then applying a second central slide on a central portion of the sheet, said process further comprising disposing the peripheral portion of the sheet to be formed on a lower blank holder which forms a tank for the cushion of elastically yieldable material and has an upper surface for maintaining the sheet and is located at a level higher than the level of the working surface of the elastically yieldable cushion, applying tte first outer slide, which has a cross-section that is less than that of the lower blank holder, and which includes on the periphery thereof an upper blank holder cooperative with the lower blank holder, for gripping the sheet, continuing the descent of the outer slide against the elastically yieldable cushion so as to turn up an edge portion of the blank of the sheet, cause the flowing of the mass of elastically yieldable cushion, deform a central portion of the sheet and impart thereto an area substantially equal to the area of the finished part to be obtained, then displacing the central slide so as to shape angular and the central portion of the sheet by a final flowing of the support.

2. A process according to claim 1, comprising forming the peripheral portion of the sheet adjacent to the turned-up edge portion by means of at least one active portion of the peripheral die carried by the outer slide so as to compensate, in certain zones of the finished part, for excess areas, for a substantially unchanged thickness of the initial sheet, relative to the volume to be formed.

3. A process according to claim 1, comprising forming the central portion of the sheet by means of at least one active portion of the bottom of the die carried by the central slide so as to compensate, in certain zones of the finished part, for excess areas, for a substantially unchanged thickness of the initial sheet, relative to the volume to be formed during the simultaneous displacement of the central slide.

4. A process according to claim 1, comprising bringing, in a first stage, the central slide to a position in which it limits the deformation of the central portion of the sheet under the effect of the flow of the cushion.

5. A process according to claim 1, wherein the material of the elastically yieldable cushion is an elastomer having a low Shore hardness.

6. A process according to claim 5, wherein the elastomer has a Shore hardness of less than 30.

7. A process according to claim 1, comprising, after the forming operation proper, causing a decompression of the material of the elastically yieldable cushion.

8. A process according to claim 1, comprising cooling the mass of the material of the elastically yieldable cushion.

9. A press-forming device comprising a support on which a sheet to be press-formed is placed, a first outer slide, a second central slide and a cushion of an elastically yieldable material, said support being constituted by a lower peripheral blank holder which forms a tank for the cushion of elastically yieldable material and has a surface on which the sheet is placed and which is located at a level higher than the level of a working surface of the elastically yieldable cushion, the outer slide comprising a body having a cross-section less than the cross-section of the lower blank holder so as to be capable of entering the latter, effecting a turning up of an edge portion of the sheet blank, reaching the cushion of elastically yieldable material and causing the flow of said material, the outer portion of the outer slide carrying an upper peripheral blank holder which is cooperative with the lower blank holder so as to grip the sheet, and the central slide carrying a die bottom.

10. A device according to claim 9, wherein the outer slide comprises on a lower surface thereof forming a peripheral die at least one active portion in relief whose shape corresponds to the excess area of the sheet, for a substantially constant thickness, relative to the volume to be formed.

11. A device according to claim 10, wherein said relief is convex.

12. A device according to claim 10, wherein said relief is concave.

13. A device according to claim 9, wherein the central slide carries a die bottom including at least one active portion in relief whose shape corresponds to the excess area of the sheet, for a substantially constant thickness, relative to the volume to be formed.

14. A device according to claim 13, wherein said relief is convex.

15. A device according to claim 13, wherein said relief is concave.

16. A device according to claim 10, wherein the material of the elastically yieldable cushion is an elastomer having a Shore hardness A of less than 30.

17. A device according to claim 13, wherein the material of the elastically yieldable cushion is an elastomer having a Shore hardness A of less than 30.

18. A device according to claim 9, comprising a die bottom carried by the central slide and made from a material which is easy to machine or shape.

19. A device according to claim 18, wherein the material of said die bottom is selected from the group consisting of a plastics material, a polyurethane, a polyepoxy, a polyester, a concrete, a concrete to which resin has been added, said materials optionally containing fibres.

20. A device according to claim 9, comprising elements which, in a first stage, project into the mass of the elastically yieldable cushion and which, in a second stage, may be retracted after the press-forming operation.

21. A device according to claim 9, comprising means for cooling within the mass of the material of the elastically yieldable cushion.

22. A device according to claim 9, comprising means for detaching the finished press-formed part from the elastically yieldable cushion.

23. A device as in claim 19 wherein said fibres are selected from the group consisting of glass fibres and hard wood fibres.

* * * * *